US006883598B2

(12) United States Patent
Sandberg

(10) Patent No.: US 6,883,598 B2
(45) Date of Patent: Apr. 26, 2005

(54) COOLING ELEMENT FOR A HEAT EXCHANGER

(75) Inventor: Per Sandberg, Västerås (SE)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/463,087

(22) Filed: Jun. 16, 2003

(65) Prior Publication Data

US 2004/0031597 A1 Feb. 19, 2004

Related U.S. Application Data

(63) Continuation-in-part of application No. 09/914,886, filed on Jan. 7, 2002.

(30) Foreign Application Priority Data

Mar. 16, 1999 (FI) ..... 990576

(51) Int. Cl.[7] ..... F28F 1/30; F28F 1/32; F28F 1/34

(52) U.S. Cl. ..... 165/151; 165/181

(58) Field of Search ..... 165/151–153, 165/181; F28F 1/30, 1/31, 1/32, 1/33, 1/34

(56) References Cited

U.S. PATENT DOCUMENTS

| | | | | | |
|---|---|---|---|---|---|
| 1,454,107 | A | * | 5/1923 | Curran | 165/153 |
| 1,458,128 | A | * | 6/1923 | Curran | 165/153 |
| 4,469,168 | A | * | 9/1984 | Itoh et al. | 165/152 |
| 4,657,070 | A | * | 4/1987 | Kluppel | 165/124 |
| 5,035,052 | A | * | 7/1991 | Suzuki et al. | 29/890.046 |
| 5,501,270 | A | * | 3/1996 | Young et al. | 165/151 |
| 6,125,926 | A | * | 10/2000 | Okamoto et al. | 165/152 |

FOREIGN PATENT DOCUMENTS

| | | | | | |
|---|---|---|---|---|---|
| GB | 2027533 | A | * | 2/1980 | 165/151 |
| JP | 55110892 | A | * | 8/1980 | F28F/1/30 |
| JP | 55118596 | A | * | 9/1980 | F28F/1/32 |
| JP | 56142394 | A | * | 11/1981 | F28F/1/30 |
| JP | 58047992 | A | * | 3/1983 | F28F/1/30 |
| JP | 58066793 | A | * | 4/1983 | F28F/1/30 |
| JP | 58178192 | A | * | 10/1983 | F28F/1/30 |
| JP | 59104094 | A | * | 6/1984 | F28F/1/30 |
| JP | 59212693 | A | * | 12/1984 | F28F/1/30 |
| JP | 61052589 | A | * | 3/1986 | F28F/1/32 |
| JP | 01169294 | A | * | 7/1989 | F28D/1/047 |
| JP | 2000039282 | A | * | 2/2000 | F28F/1/30 |

* cited by examiner

*Primary Examiner*—Leonard R. Leo
(74) *Attorney, Agent, or Firm*—Smith-Hill and Bedell

(57) ABSTRACT

A heat exchanger includes at least two ducts for separating a first heat exchange fluid, inside the ducts, from a second heat exchange fluid, outside the ducts, the ducts having longitudinal axes that are substantially parallel to one another. A substantially planar cooling element is formed with apertures through which the ducts extend. The cooling element is inclined at a first predetermined acute angle to the longitudinal axes of the ducts. The cooling element is provided with louvers that are inclined at a second predetermined acute angle to the general plane of the cooling element. The first and second predetermined acute angles are substantially equal in magnitude.

10 Claims, 3 Drawing Sheets

COOLING ELEMENT FOR A HEAT EXCHANGER

CROSS-REFERENCE TO RELATED APPLICATION

This application is filed as a continuation-in-part of copending patent application Ser. No. 09/914,886, having a 35 USC 371 acceptance date of Jan. 7, 2002 and based on International Application No. PCT/FI2000/00145 filed Feb. 23, 2000. The entire disclosure of patent application Ser. No. 09/914,886 is hereby incorporated by reference herein for all purposes.

BACKGROUND OF THE INVENTION

The invention relates to a cooling element provided with louvers to be used in a heat exchanger, particularly in a heat exchanger constructed so that the cooling element is under the influence of passing cooling medium, as air or water, used for cooling another medium flowing inside a circulating element and that the cooling element is used as a connecting member for two circulating elements.

A heat exchanger used in the automotive industry for cooling a motor in a vehicle may include a fin made of a corrugated strip. The corrugated strip itself is made of copper, copper-based alloy or aluminum or aluminum-based alloy and this corrugated strip is installed between circulating elements where medium to be cooled is circulated. The corrugated strip has a strong metallic bond made by a braze or a solder material with the circulating elements. One corrugated strip provides many cooling elements or fins between circulating elements. Further, the fins positioned between two circulating elements are installed substantially perpendicularly to the longitudinal direction of the fin. The fins may be cut between the two circulating elements to form a number of louvers twisted at an angle of 20–45° from the general plane of the fins. The louvers, which are provided for improving heat transfer capacity, are very small, from 0.75 to 1.5 mm, but the louvers are very efficient for the heat transfer capacity. The louvers are grouped together in different areas distributed along the direction of flow of the (outer) cooling medium. The louvers in a given area are twisted in one direction and the louvers in the or each adjacent area are twisted in the opposite direction.

When a cooling medium, such as air or water, is passing over the fins, the cooling medium is forced to follow a flow pattern defined by the louvers. At low cooling medium flow levels the flow has in spite of louvers space enough to pass directly between the fins. On the contrary, at moderate or high cooling medium flow levels the flow may be redirected several times and pass through the fins. This means more costs because of energy loss and this effect can be measured as a higher pressure drop over the heat exchanger.

The object of the present invention is to eliminate some drawbacks of the prior art and to achieve a cooling element to be used in a heat exchanger, particularly in a heat exchanger where the cooling element is a connecting member between two circulating elements.

SUMMARY OF THE INVENTION

In accordance with a first aspect of the invention there is provided a heat exchanger comprising at least first and second ducts for separating a first heat exchange fluid, inside the ducts, from a second heat exchange fluid, outside the ducts, the first and second ducts having longitudinal axes that are substantially parallel to one another, and a substantially planar cooling element formed with apertures through which the first and second ducts extend, the cooling element being inclined at a first predetermined acute angle to the longitudinal axes of the first and second ducts, and the cooling element also being provided with louvers that are inclined at a second predetermined acute angle to the general plane of the cooling element, the first and second predetermined acute angles being substantially equal in magnitude.

In accordance with a second aspect of the invention there is provided a heat exchanger comprising at least first and second ducts for separating a first heat exchange fluid from a second heat exchange fluid, the first and second ducts having longitudinal axes that are substantially parallel to one another, and at least first and second substantially planar cooling elements each formed with apertures through which the first and second ducts extend, the cooling elements being substantially parallel to each other and being inclined at a first predetermined acute angle to the longitudinal axes of the first and second ducts, and each cooling element also being provided with louvers that are inclined at a second predetermined acute angle to the general plane of the cooling element, the first and second predetermined acute angles being substantially equal in magnitude.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
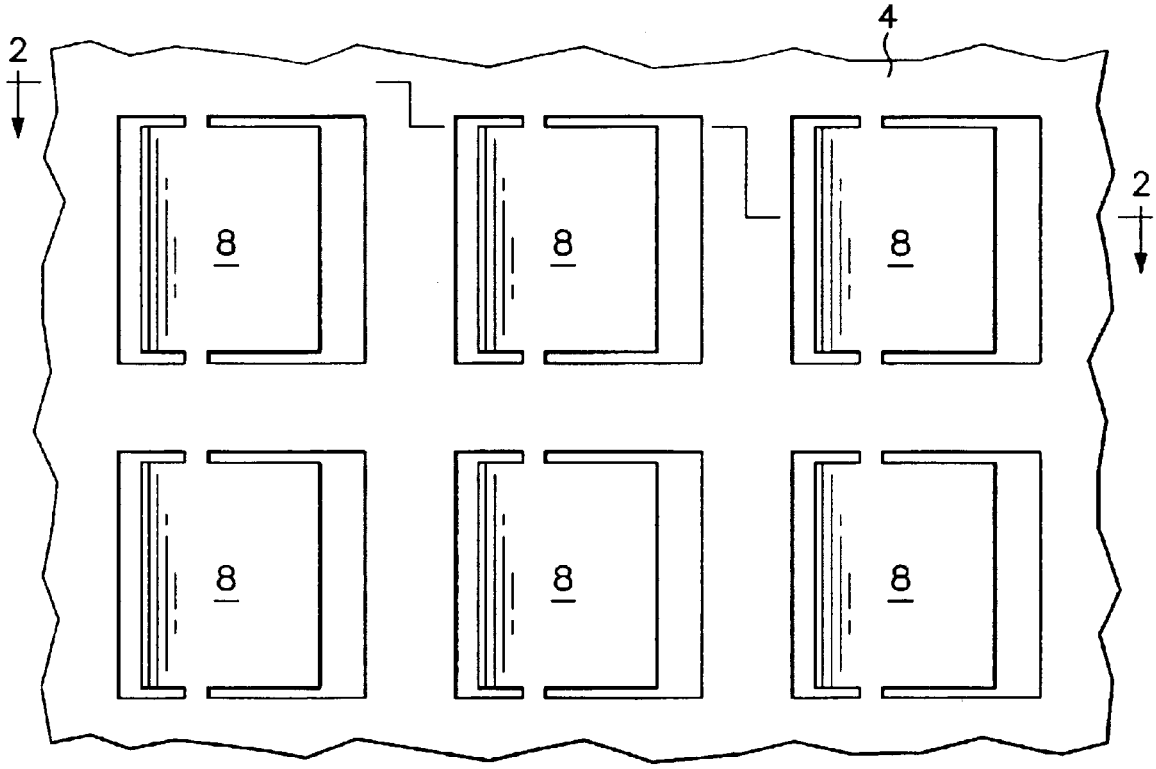
FIG. 1 is an enlarged elevation view of a fin used in a heat exchanger embodying the present invention.
Figure 2:
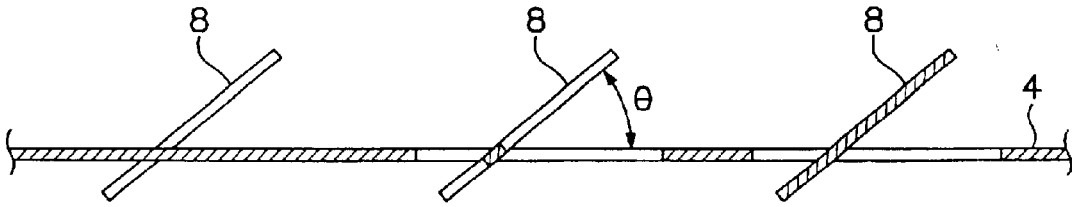
FIG. 2 is a sectional view taken on the line 2—2 of FIG. 1.

The heat exchanger shown in FIGS. 1–4 comprises multiple circulating elements or ducts 2 and multiple fins 4 made of copper, a copper-based alloy, aluminum, or an aluminum-based alloy. Referring to FIGS. 1 and 2, each fin is stamped to define rectangular apertures 6. The fins and the ducts are assembled so that the ducts pass through the apertures 6. The ducts are typically made of a metal having good thermal conductivity and are strongly bonded to the fins, e.g. by brazing or soldering. A first heat exchange fluid flows through the ducts 2 and a second heat exchange fluid, outside the ducts, flows in a direction that is generally parallel to the planes of the fins, as shown by the arrow B in FIG. 3.

Figure 3:
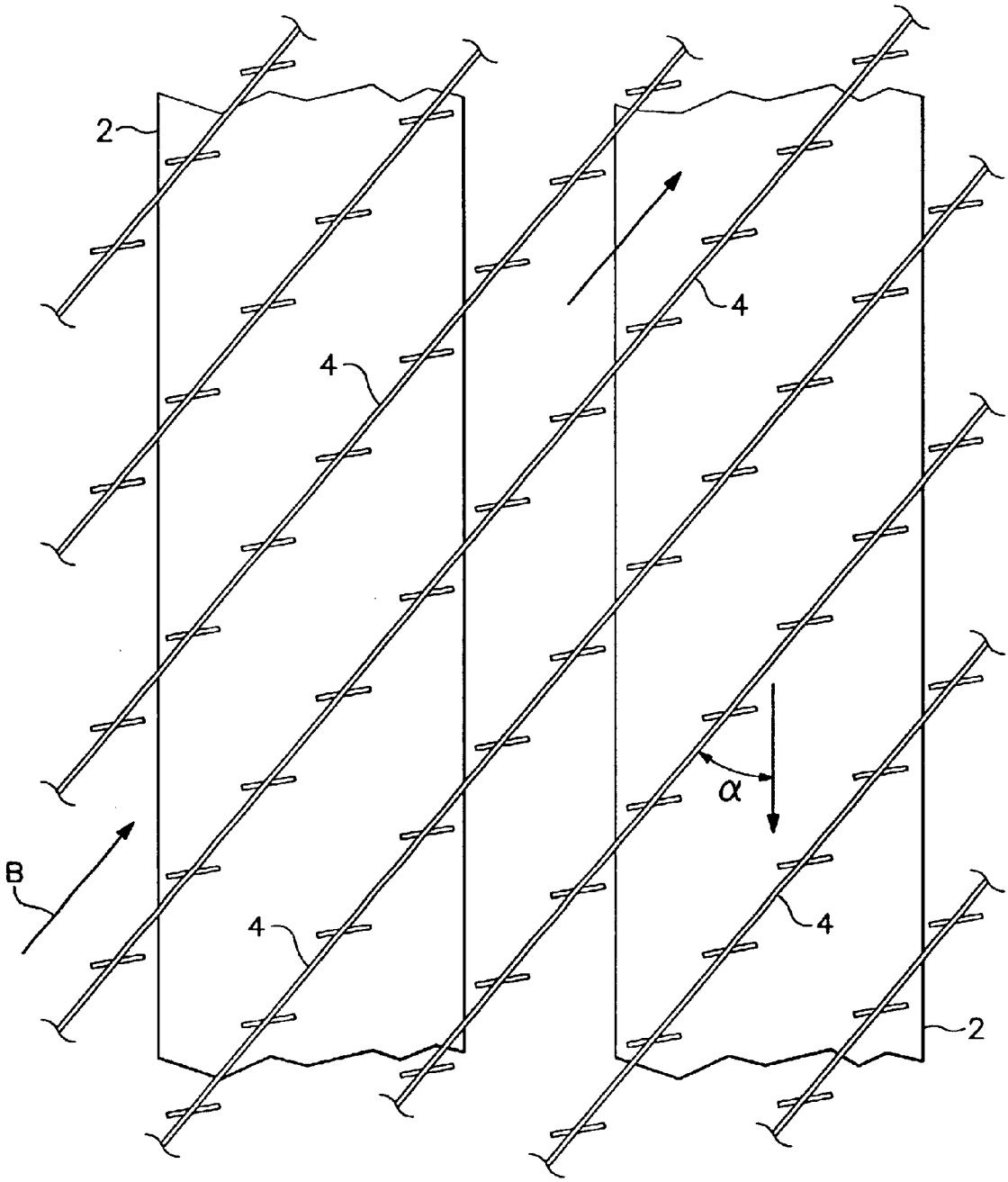
FIG. 3 is a top plan view of the heat exchanger.
Figure 4:
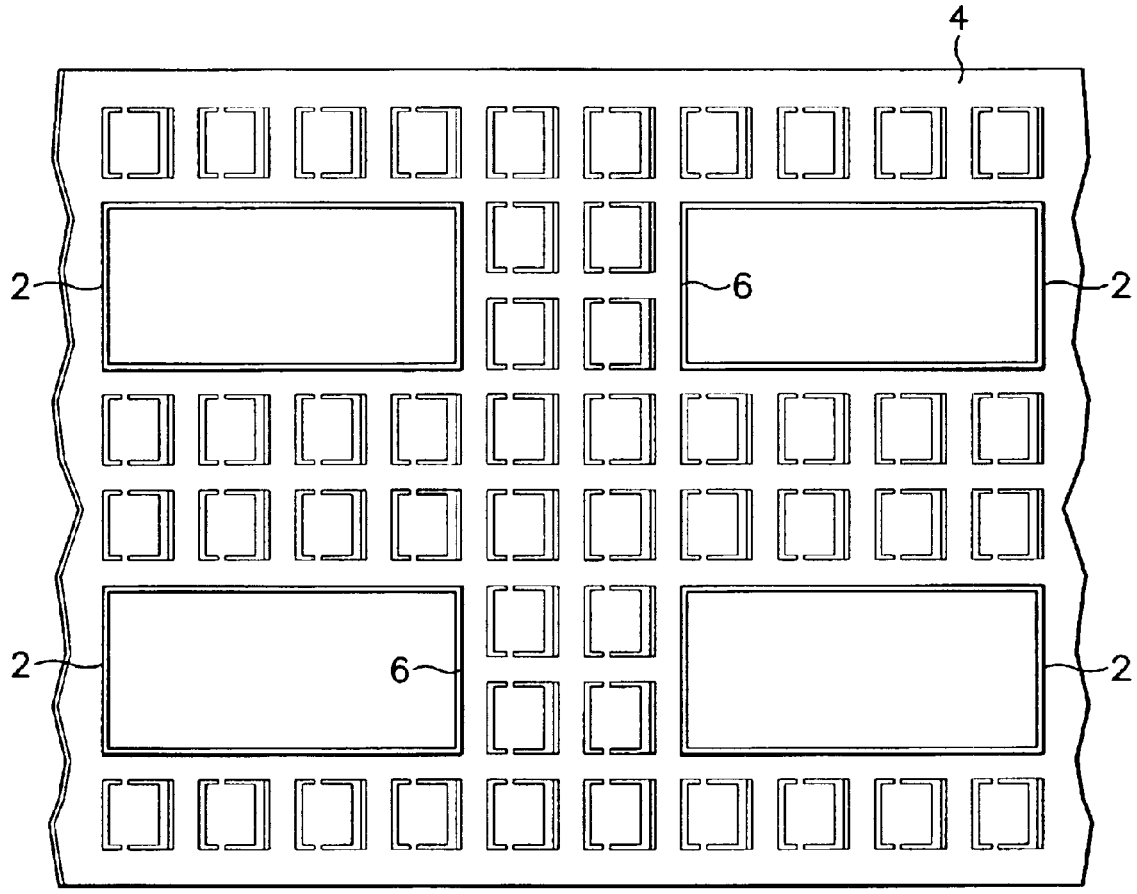
FIG. 4 is a sectional view taken on a line parallel to one of the fins shown in FIG. 3.

Each fin is stamped to form a square array of louvers 8, which are twisted through an acute angle $\theta$ in the range 20–45°, advantageously in the range 25–35°, from the general plane of the fins 4. The pattern in which the louvers are formed is such, relative to the dimensions and spacing of the apertures 8, that each louver is connected to the main body of the plate 4 at two locations, and is therefore securely supported. The relative sizes of the louvers 8 and apertures 6 shown in FIGS. 3 and 4 is distorted in order to show the louvers clearly. The louvers would in practice be much smaller than the apertures.

As shown in FIG. 3, each fin 4 is oriented relative to the longitudinal direction of the duct at an angle $\alpha$, which is substantially the same as the angle $\theta$ through which the louvers are twisted from the general plane of the fin. As shown in FIGS. 2 and 3, the louvers are twisted through about 40° from the general plane of the fin, and the general plane of the fin is inclined at about 35° from the longitudinal direction of the ducts. It has been found that this arrangement of louvers and fins relative to the ducts provides favorable flow conditions for the second heat exchange fluid, and avoids redirection of the flow at moderate or high flow levels.

As shown in FIG. 3, the fins are parallel to each other and the louvers are parallel to each other over the entire heat exchanger so that there is no redirection of flow.

It will be appreciated that the invention is not restricted to the particular embodiment that has been described, and that variations may be made therein without departing from the scope of the invention as defined in the appended claims and equivalents thereof. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated.

What is claimed:

1. A heat exchanger comprising:

at least first and second ducts for separating a first heat exchange fluid, inside the ducts, from a second heat exchange fluid, outside the ducts, the first and second ducts having longitudinal axes that are substantially parallel to one another, and a substantially planar cooling element formed with apertures through which the first and second ducts extend, the cooling element being inclined at a first predetermined acute angle to the longitudinal axes of the first and second ducts, and the cooling element also being provided with louvers that are inclined at a second predetermined acute angle to the general plane of the cooling element, the first and second predetermined acute angles being substantially equal in magnitude.

2. A heat exchanger according to claim 1, wherein the magnitude of the second predetermined acute angle is in the range from 20 to 45 degrees.

3. A heat exchanger according to claim 2, wherein the magnitude of the second predetermined acute angle is in the range from 25 to 35 degrees.

4. A heat exchanger according to claim 1, wherein the cooling element is made of copper, a copper alloy, aluminum, or an aluminum alloy.

5. A heat exchanger according to claim 1, wherein the cooling element is brazed or soldered to the ducts.

6. A heat exchanger comprising:

at least first and second ducts for separating a first heat exchange fluid from a second heat exchange fluid, the first and second ducts having longitudinal axes that are substantially parallel to one another, and at least first and second substantially planar cooling elements each formed with apertures through which the first and second ducts extend, the cooling elements being substantially parallel to each other and being inclined at a first predetermined acute angle to the longitudinal axes of the first and second ducts, and each cooling element also being provided with louvers that are inclined at a second predetermined acute angle to the general plane of the cooling element, the first and second predetermined acute angles being substantially equal in magnitude.

7. A heat exchanger according to claim 6, wherein the magnitude of the second predetermined acute angle is in the range from 20 to 45 degrees.

8. A heat exchanger according to claim 7, wherein the magnitude of the second predetermined acute angle is in the range from 25 to 35 degrees.

9. A heat exchanger according to claim 6, wherein the cooling elements are made of copper, a copper alloy, aluminum, or an aluminum alloy.

10. A heat exchanger according to claim 6, wherein the cooling elements are brazed or soldered to the ducts.

* * * * *